United States Patent [19]

Kashiwagi et al.

[11] 4,361,742

[45] Nov. 30, 1982

[54] VACUUM POWER INTERRUPTER

[75] Inventors: Yoshiyuki Kashiwagi; Shuzo Tanigaki, both of Tokyo; Naoki Kondo, Yokohama; Tsutae Suzuki, Tokyo, all of Japan

[73] Assignees: Kabushiki Kaisha Meidensha; Kabushiki Kaisha Gemvac, both of Tokyo, Japan

[21] Appl. No.: 170,045

[22] Filed: Jul. 17, 1980

[30] Foreign Application Priority Data

Jul. 23, 1979 [JP] Japan ..... 54-93526

[51] Int. Cl.[3] ..... H01H 33/66

[52] U.S. Cl. ..... 200/144 B

[58] Field of Search ..... 200/144 B

[56] References Cited

U.S. PATENT DOCUMENTS 4,020,304 4/1977 Cherry ..... 200/144 B

OTHER PUBLICATIONS

Sudarshan et al., "The Effect of Chromium Oxide Coatings on Surface Flashover of Alumina Spacers in Vacuum", IEEE Transactions on Electrical Insulation, Mar. 1976, pp. 34–36.

*Primary Examiner*—Robert S. Macon

*Attorney, Agent, or Firm*—Lowe, King, Price & Becker

[57] ABSTRACT

A vacuum power interrupter is disclosed wherein a chromium oxide film is formed on a surface of a stainless steel shield disposed within a vacuum vessel, thereby making it possible to improve the flashover voltage and interrupting ability.

3 Claims, 5 Drawing Figures

VACUUM POWER INTERRUPTER

BACKGROUND OF THE INVENTION

The present invention relates to a vacuum power interrupter, and more particularly to a vacuum power interrupter wherein a chromium oxide film is formed on a surface of a stainless steel shield disposed within a vacuum vessel.

In prior art vacuum power interrupters to improve flashover voltage, known improvements are made as follows; (a) increasing the number of gaps between shields, between shield and electrical contacts, or between shield and end plates, (b) division of gaps through use of compound shields, (c) a formation of uniform gap electric filed due to an improvement of a form of a shield. However, concerning vacuum power interrupters for high voltage use, primary electron emission increases from electrical contacts or contact rods. The primary emission is accelerated by an electric field and collides with the surface of the shield.

On the other hand, shields made from stainless steel or non-magnetic material are used to suppress eddy currents. An oxide film having a thickness of 10 Å is formed on the shield surface. The oxide film, such as $Fe_2O_3$, (non-crystalline) and deposited on the shield in a vacuum of approximately $10^{-4}$ Torr with a surface analytical apparatus (Auger electron spectroscopy, or X-ray electron spectroscopy etc.). In connecting with a coefficient $\delta$ of emission of secondary electrons of $Fe_2O_3$ (number of a radiative secondary electron number of a incident primary electron), its maximum value is larger than 1, as expressed by following expression $\delta$ max$>1$.

Accordingly, when the primary electrons collide with the shield surface, a number of secondary electrons larger than the number of primary electrons is radiated from the shield. An insulating breakdown between shields occurs, or, between the shield and an electrical contact, or between contact rods. Therefore, with such prior art vacuum circuit breakers, it is impossible to obtain a sufficient flashover voltage.

SUMMARY OF THE INVENTION

An object of the present invention is to provide a vacuum power interrupter having an increased flashover voltage for improved interrupting ability.

Another object of the present invention is to provide a vacuum power interrupter wherein a chromium oxide film is formed on a stainless steel shield surface disposed within a vacuum vessel.

According to the present invention, a vacuum power interrupter includes a chromium oxide film formed on a stainless steel shield surface disposed within a vacuum vessel. The entire surface substantially surrounding the electrical contacts is coated to improve flashover voltage and interrupting ability.

BRIEF DESCRIPTION OF THE DRAWINGS

The features and advantages of a vacuum power interrupter will become more apparent from the following description taken in conjunction with the accompanying drawings, in which.

DETAILED DESCRIPTION OF THE INVENTION

Figure 1:
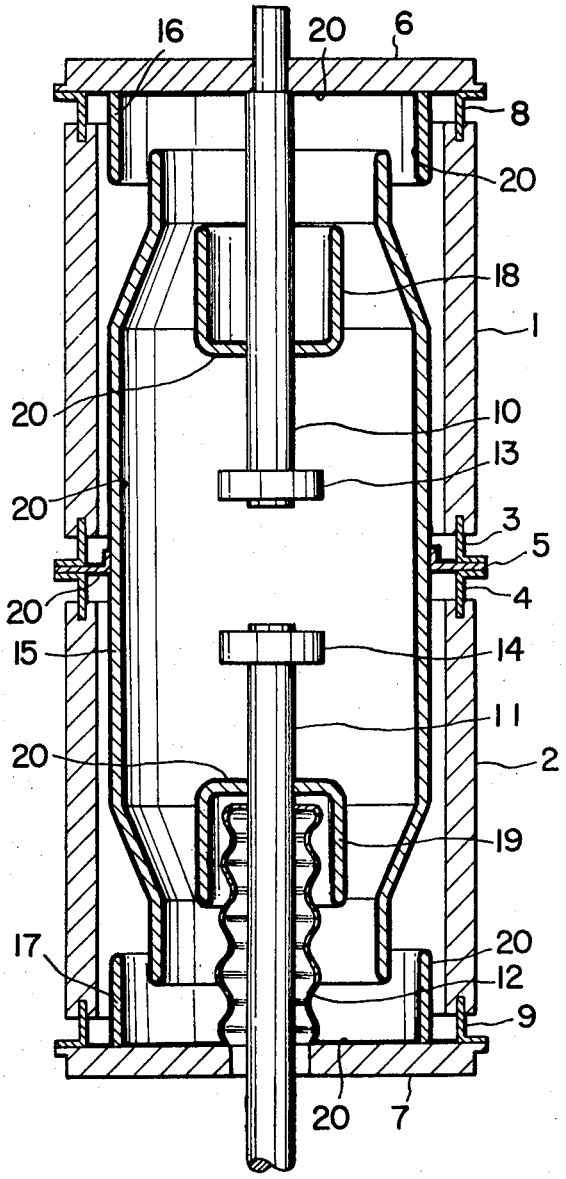
FIG. 1 is a longitudinal cross-sectional view of a vacuum power interrupter according to a first embodiment of the present invention.

Referring to FIG. 1, insulating envelopes 1 and 2 are connected with connecting rings 3 and 4 and a supporting metal fitting 5. End plates 6 and 7 are respectively hermetically connected to the outer ends of the insulating envelopes 1 and 2 through connecting rings 8 and 9 to form the vacuum vessel body. A stationary contact rod 10 is connected through end plate 6. A movable contact rod 11 is provided through end plate 7 and a bellows 12. Stationary and movable electrical contacts or electrodes 13 and 14 ae respectively provided on the free ends of contact rods 10 and 11 so as to face each other. A main shield member 15 is fixed to metal fitting 5. External shield members 16 and 17 are respectively attached to end plates 6 and 7. Axial shield member 18 and bellows shield member 19 are fixed to contact rods 10 and 11, respectively. Shield members 15–19 are provided to prevent lowering of the flashover voltage that occurs when electron particles travelling in an arc adhere to insulating envelopes 1 and 2 or collide with each other to produce secondary electrons. To suppress eddy currents, all shield members 15–19 are made of stainless steel.

According to the invention, a film layer 20 of chromium oxide ($Cr_2O_3$) having an approximate thickness in the range from 30 Å to 200 Å is formed on each shield member surface, end plates 6 and 7, and the surface of supporting metal fitting 5. Layer 20 is formed within the vacuum vessel interior by an ionization evaporation process or deposit under vacuum conditions.

In the above vacuum power interrupter of the invention, the maximum value of the coefficient of emission of secondary electrons of film 20 is nearly equal to 1, which is expressed as follows: $\delta$ max$\approx 1$. Accordingly, during interruption, if a primary electron collides with the surface of shield members 15–19, end plates 6 and 7, or metal fitting 5, the number of secondary electrons emitted is the same as the number of primary electrons. In this manner, the multiplying action of electrons does not occur, resulting in improved flashover prevention characteristics within the vacuum vessel and interrupting ability.

Figure 2:
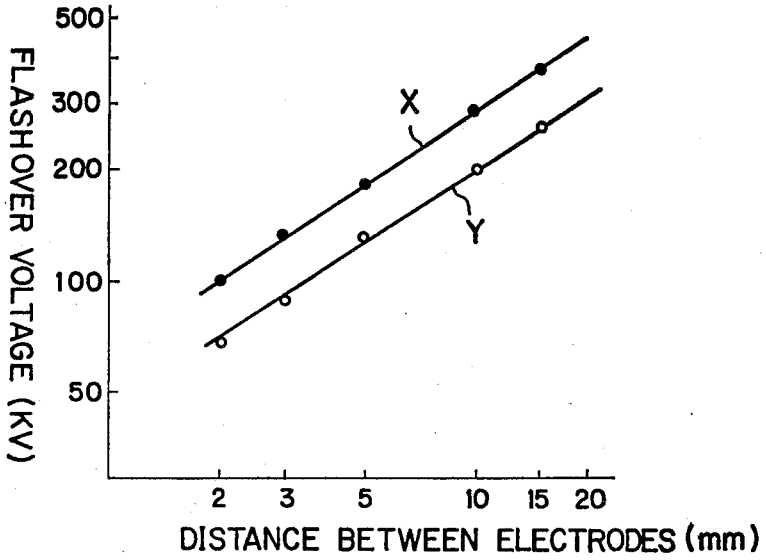
FIG. 2 is a graph of the relationship of a distance between electrodes and flashover voltage in the presence and in the absence of a film of $Cr_2O_3$ on a surface of a shield of stainless steel disposed within a vessel.

FIG. 2 shows a graph illustrating the relationship of distance between electrodes and an impulse withstand voltage (flash over voltage) wherein reference numeral X indicates the presence of chromium oxide film coating, while reference numeral Y indicates surfaces 15–19 placed in an amorphous condition without the film. As is apparent from FIG. 2, the flashover voltage when chromium oxide film is used is 1.3 times as large as that when such film is not used.

Figure 3:
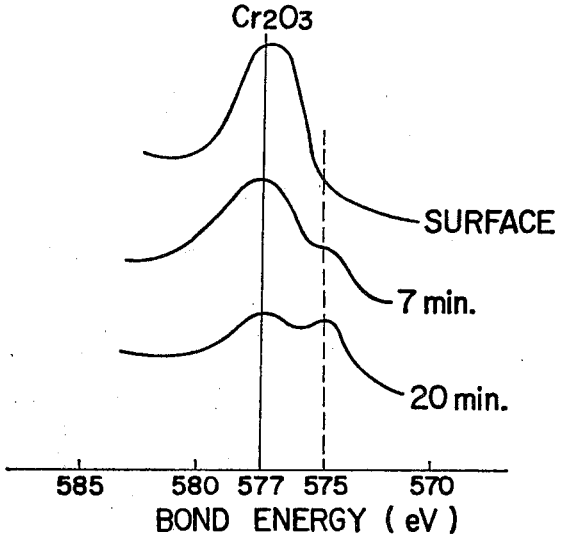
FIG. 3 is a photoelectron spectrum of stainless steel on which a film of $Cr_2O_3$ is coated.

FIG. 3 shows an electron spectroscopic spectrum of a stainless steel surface wherein film 20 is formed on the surface of shield members 15–19. This measurement is carried out in a vacuum of $10^{-9}$ Torr with an X-ray spectron spectroscopic device (X-ray source is Al K$\alpha$ 15KV, 40 mA).

According to this experiment, the peak value of the spectrum is coincident with the bond energy of $Cr_2O_3$ at a 577 eV. It is determined that the film 20 is $Cr_2O_3$. Further, in order to measure the thickness of the film 20, with a sputtering of $Ar^+$, an etching of the film is effected. As the etching proceeds, the spectrum varies as shown in FIG. 3. For instance, after twenty minutes passes, 575 eV which corresponds to a bond energy of a metal chromium $\overset{\circ}{Cr}$ is detected.

On the basis of the sputtering energy of $Ar^+$, bonding condition between molecules constituting the film of $Cr_2O_3$, and the above mentioned measured time, it is determined that the thickness of the film 20 is a specified one which lies in the range of 30 Å to 200 Å. Since the emitting portion of the secondary electrons lies in the region of thickness which is several ten Å from the surface, the thickness of the film is sufficient if the film has the above mentioned thickness.

Reference is made to another method of making a film 20 of $Cr_2O_3$. This method comprises the steps of (1) immersing an oxidizing agent such as a nitric acid or other powerful oxidizing agent into an aqueous solution, (2) effecting an electrolytic polishing to the surface, (3) effecting a vacuum deposit of $Cr_2O_3$ in a vacuum, and (4) heating at a low temperature in an atmosphere of oxygen or air.

Figure 4:
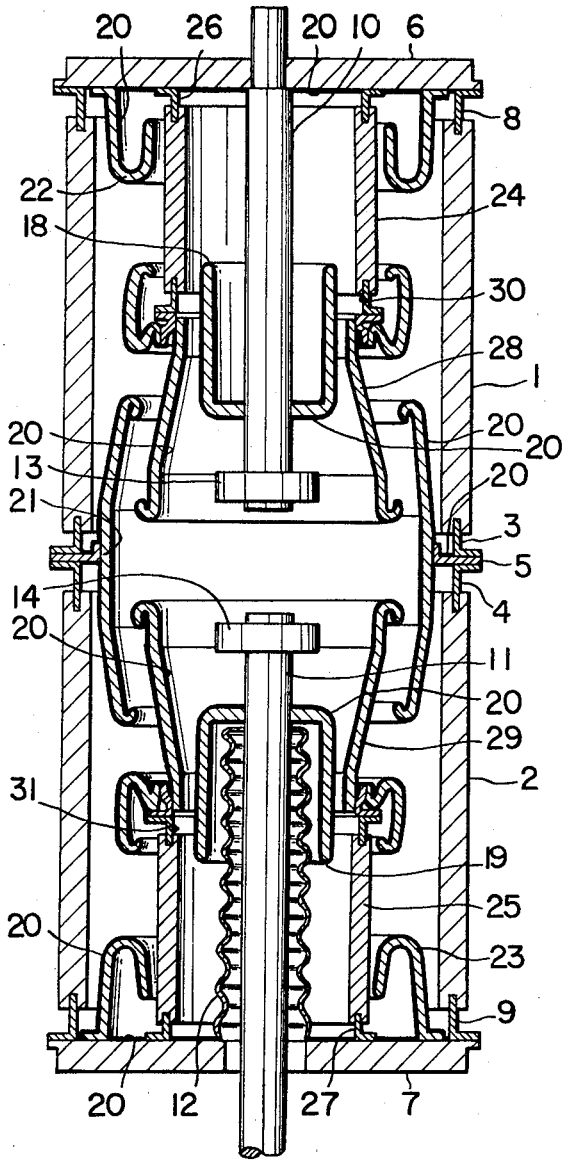
FIGS. 4 and 5 are longitudinal cross-sectional views of a vacuum power interrupter according to second and third embodiments of the present invention, respectively.

Referring to FIG. 4, a second embodiment of the present invention is shown. The same or similar parts as that of the first embodiment are designated by the same reference numerals, of which explanation will be omitted.

A main shield 21 is fixed to the supporting metal fitting 5. External shields 22 and 23 are mounted to end plates 6 and 7, respectively. Shield supporting and insulating envelopes 24 and 25 are fixed to the end plates 6 and 7 with connecting rings 26 and 27, internal shields 28 and 29 are respectively fixed to the shield supporting and insulating envelopes 24 and 25 with connecting rings 30 and 31. Each shield member 21–23, 28 and 29 are made of stainless steel. Film 20 of $Cr_2O_3$ is formed on the surface thereof with a thickness greater than 30 Å.

In this embodiment, the flashover voltage is increased by dividing the vacuum gap with each shield member 18, 19, 21–23, 28 and 29. Thus, the film of $Cr_2O_3$ is formed on the surface of each shield member. As a result, the level of emission of secondary electrons from each shield member decreases, thereby improving the flashover voltage.

Figure 5:
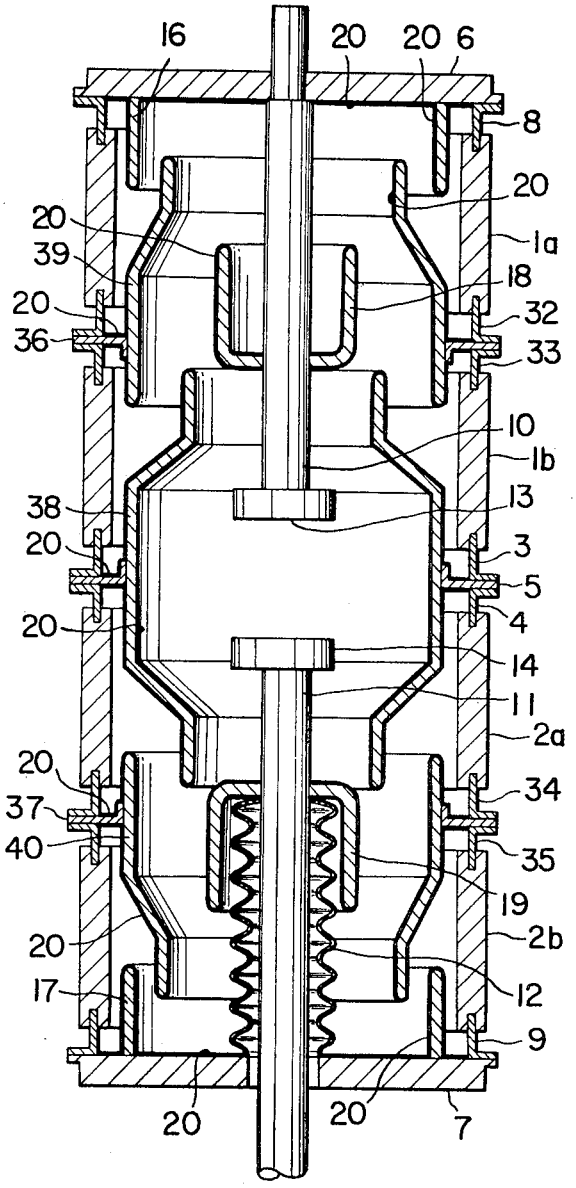

FIG. 5 shows a third embodiment according to the present invention. Parts similar to that shown in the second embodiment are denoted with like reference numerals, of which explanation is omitted.

Reference numerals 1*a*, 1*b*, 2*a*, and 2*b* denote the insulating envelope connecting rings 32–35 are provided between the insulating envelopes. Supporting metal fittings 36 and 37 of stainless steel are provided between connecting rings 32–35. A first main shield member 38 is connected to the supporting metal fitting 5. Second main shield members 39 and 40 connected to the supporting metal fittings 36 and 37. Each shield member 38–40 is made of stainless steel. A film 20 of $Cr_2O_3$ is formed with a thickness of 30 Å by means of the above mentioned procedure.

In this embodiment, the same effect is obtained as that of the second embodiment.

From the foregoing description, according to the present invention, the film of $Cr_2O_3$ is formed on a surface of a shield of stainless steel provided within a vacuum vessel. As a result, the coefficient of an emission of a secondary electron is expressed by the following expression; $\delta\ max \approx 1$. On the contrary, in the prior art, the corresponding coefficient is expressed as follows; $\delta\ max > 1$. As a result, the level of emissions of secondary electrons in the shield decreases during the interrupting action. Therefore, there hardly occurs an electric breakdown between shields, between shield and electrical contact, and between shield and contact rod. The flashover voltage in the presence of the film is 1.5 times as large as that in the absence of the film.

Accordingly, the interrupting ability is improved to obtain a small sized and low cost vacuum power interrupter. So as to obtain such an effect, it is sufficient to form a film of $Cr_2O_3$ on the surface of the shield member. Further it is unnecessary to change the shape of the shield member, thereby facilitating the fabrication thereof.

It is to be understood that modifications and variations of the embodiments of the invention disclosed herein may be resorted to without departing from the spirit of the invention and the scope of the appended claims.

What is claimed is:

1. A vacuum power interrupter comprising a pair of electrical contacts disposed within a substantially cylindrical vacuum vessel so as to be movable into and out of contact with each other, and a shield member of stainless steel disposed within said vacuum vessel, the improvement wherein substantially an entire surface of said shield member facing or surrounding the electrical contacts is coated with a chromium oxide film.

2. A vacuum power interrupter as defined in claim 1, wherein said chromium oxide film is formed on a substantially entire inner surface of end plates provided on axial ends of said vacuum vessel.

3. A vacuum power interrupter according to claim 2 or 3, wherein said chromium oxide film has a thickness in the approximate range of 30 Å to 200 Å.

* * * * *